US005336135A

United States Patent [19]

Keyvani

[11] Patent Number: 5,336,135

[45] Date of Patent: Aug. 9, 1994

[54] AMUSEMENT APPARATUS

[76] Inventor: Daryoush Keyvani, 321 S. San Vicente Blvd. #302, Los Angeles, Calif. 90048

[21] Appl. No.: 847,354

[22] Filed: Mar. 6, 1992

[51] Int. Cl.[5] ..... A63B 5/00

[52] U.S. Cl. ..... 472/137; 482/27; 182/137; 182/138; 182/139

[58] Field of Search ..... 472/137; 182/137, 138, 182/139, 178; 482/26, 27, 30, 31

[56] References Cited

U.S. PATENT DOCUMENTS

| | | | |
|---|---|---|---|
| 503,572 | 8/1893 | Beal | 182/140 X |
| 896,213 | 8/1908 | Kerfoot | 182/138 |
| 4,452,444 | 6/1984 | Schulze | 482/27 |
| 4,474,369 | 10/1984 | Gordon | 482/27 |
| 4,535,983 | 8/1985 | de la Concha-Caceres | 472/137 |
| 4,548,405 | 10/1985 | Lee | 482/26 |
| 4,743,007 | 5/1988 | de la Concha-Caceres | 472/137 |
| 4,863,156 | 9/1989 | Shaw | 482/27 |
| 4,938,473 | 7/1990 | Lee | 482/27 |

*Primary Examiner*—Carl D. Friedman
*Assistant Examiner*—Beth A. Aubrey
*Attorney, Agent, or Firm*—Lawrence S. Cohen

[57] ABSTRACT

In one embodiment the amusement device is a series of trampolines arranged vertically and offset to allow a user, starting at the top to spring serially from the uppermost to lower trampolines. A tram can deliver the user to the top. In another embodiment, a trampoline is described which has a rigid support structure except for a portion which is deflectable when excess force is applied so as to prevent injury to a user.

23 Claims, 3 Drawing Sheets

FIG. 1
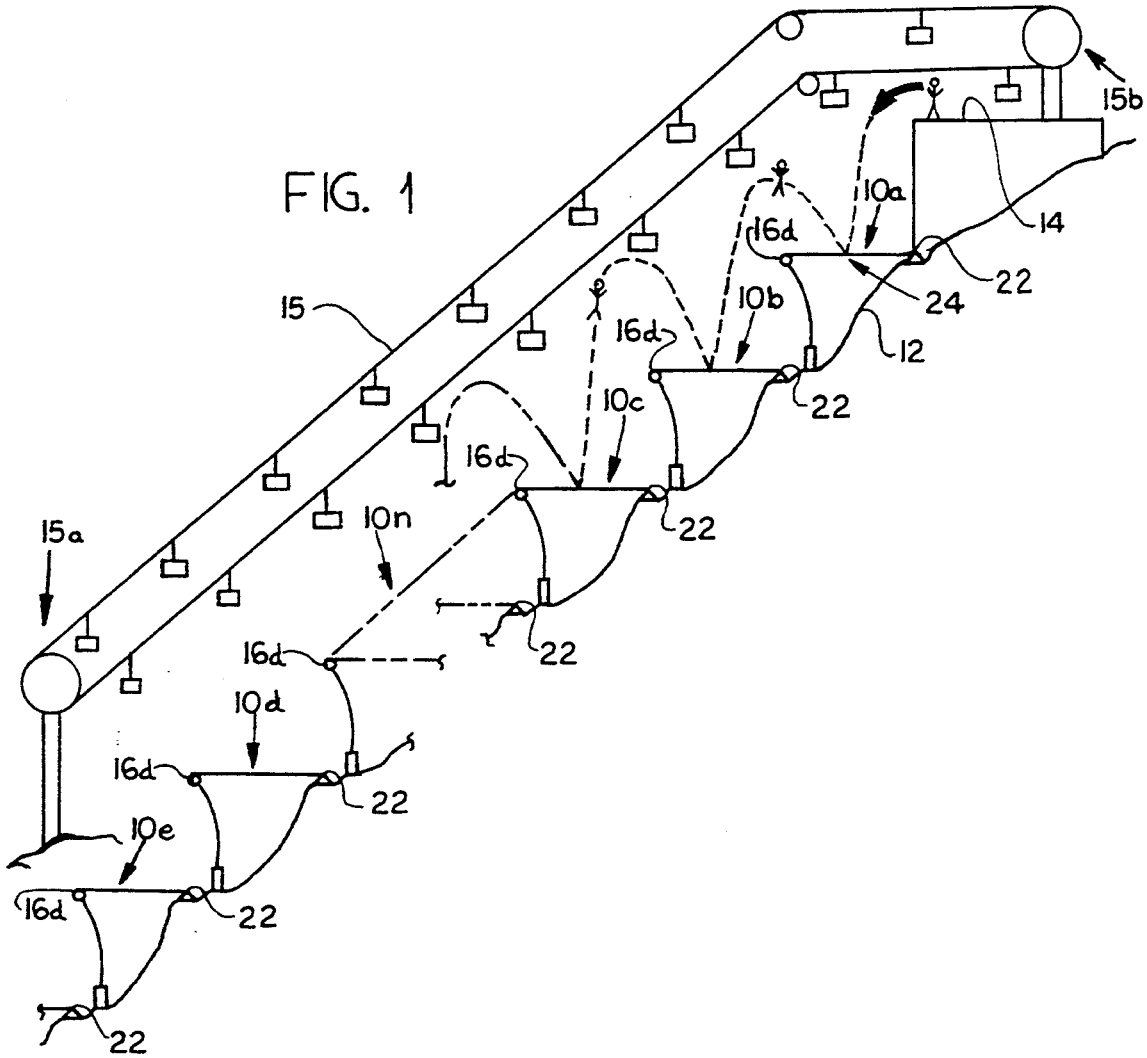
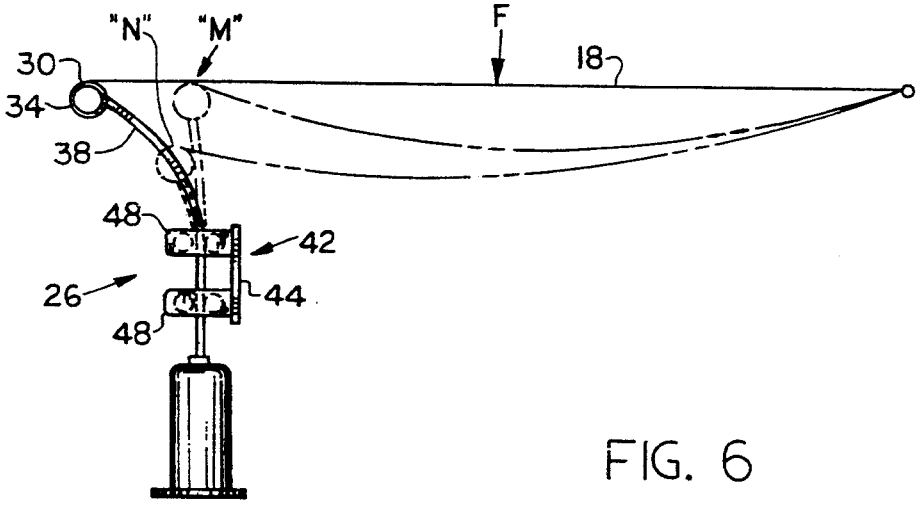
FIG. 6

AMUSEMENT APPARATUS

FIELD OF THE INVENTION

This invention relates to amusement devices, in particular of the type which employs a trampoline.

SUMMARY OF THE INVENTION

In one aspect the invention comprises a series of trampolines which are arranged laterally adjacent and in vertically offset levels to permit a user to move progressively downward from one to the next adjacent one. In another aspect the invention comprises a trampoline in which one supporting edge is deflectable in order to absorb an excess force such as if the user jumps too close to that edge or even directly on the edge. The means for permitting this deflection are various, two different structures are described. Specifically, in one structure the supporting could be a wire supported at the opposite ends. In still further aspect, the wire can be supported by a spring which allows additional deflection if the applied force is sufficient to overcome the spring force.

BRIEF DESCRIPTION OF THE DRAWINGS

FIG. 1 is an overall schematic partial side view of the invention.

FIG. 6 is a side view of the outer support assembly as attached to a trampoline showing various positions.

DESCRIPTION OF THE INVENTION

As shown in FIG. 1, this invention is constructed of a series of trampoline assemblies 10 the series being shown as 10*a*–10*e* which are installed on a slope 12 so that they are successively laterally adjacent and vertically offset. The number of trampoline assemblies is two or more, any number being possible. As constructed, a starting platform 14 is provided. Not shown is a finishing area which could be a pool of water or a bed of foam or other soft landing material. Also a potential energy storage device is included in the form a lift 15; which will transport an individual from the bottom of the lift 15*a* to the top of the lift 15*b*.

Figure 2:
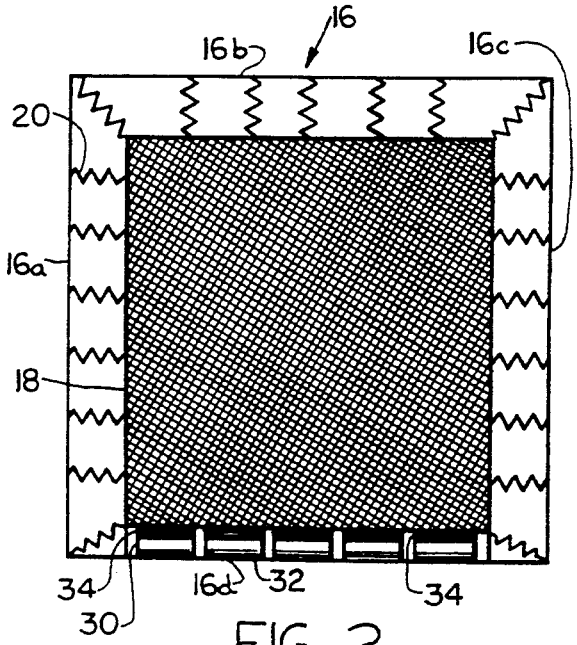
FIG. 2 is a plan view of a trampoline as used in the invention.

Referring to FIGS. 1 and 2 each trampoline assembly 10 has a rigid peripheral frame or support structure 16 comprising three sides 16*a*, 16*b* and 16*c* of similar construction. A fourth side 16*d* is of a different construction to be described in detail below. A trampoline pad 18 is situated centrally in the frame 16. The pad 18 is rectangular or square and is held in place by springs 20 distributed around the pad 18 between the pad 18 and the frame 16, except along the side 16*d*. Other shapes could be employed.

Side 16*b* of the trampoline assembly defines an inner edge or boundary and side 16*d* defines an outer edge or boundary of the trampoline assembly. The inner edge 16*b* is seated on the slope as schematically shown at 22 in FIG. 1. Sides 16*a* and 16*c* of the trampoline assembly define side edges or boundaries. The uppermost trampoline 10*a* extends laterally from where it is seated on the slope at 22 to its outer edge 16*d*. The next trampoline 10*b* has its inner edge 22 generally vertically below, that is vertically offset from trampoline 10*a*, and laterally adjacent trampoline 10*a*. This relationship is carried through the successive trampoline assemblies, 10*c*, 10*d*, 10*e* and any intermediate trampoline assemblies 10*n*.

Figure 3:
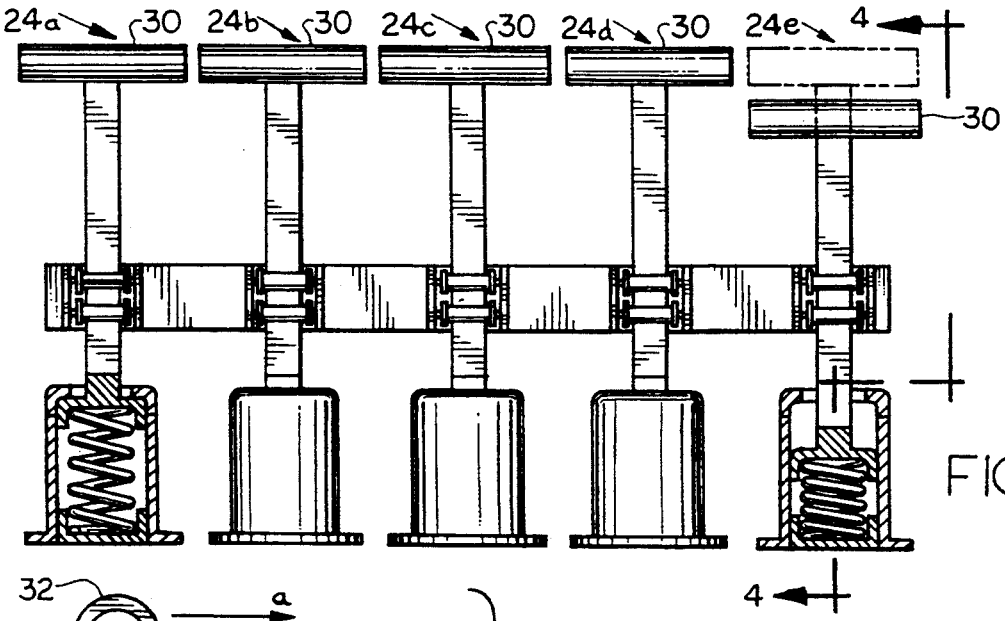
FIG. 3 is a front view of a first embodiment of the outer support assembly.
Figure 4:
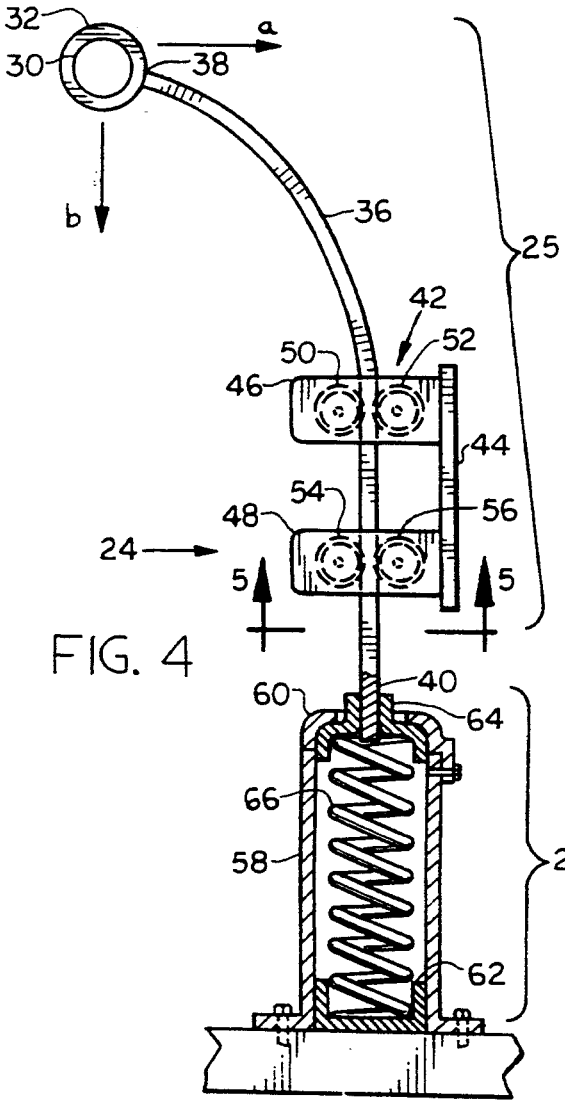
FIG. 4 is a side view of the outer support assembly partially in section through 4—4 of FIG. 3.

Next is described the construction of the outer edge 16*d* and its support assembly 24, which are shown in FIGS. 3, 4, 5 and 6. The support assembly 24 has three primary functions. First, it holds the trampoline in a ready to use position. Second it deflects or flexes inwardly when a large inward force vector is imposed as shown in FIG. 4 by arrow "a". Third it deflects downwardly when a large downward force vector is imposed as shown in FIG. 4 by arrow "b". As will be explained below, the inward force vector "a" is expected to occur when a person jumps onto the trampoline pad 18. A downward force vector "b" will also occur from such an event. A downward force vector "b" can also occur if a person jumps directly onto or close to the outer edge 16*d*. The purpose of this special structure is to provide selective flexing of the structure if a person hits the trampoline assembly too close to the outer boundary, thereby avoiding possible injury.

The support assembly 24 comprises a first portion 26 defining a lateral support portion and a second portion 28 defining a vertical support portion. Referring to FIG. 3 in this embodiment five separate support assemblies 24*a*– 24*e* are shown. However, any convenient number can be chosen. In fact, the number of first portions 26 could be different from the number of second portions 28 such as if a plurality of first portions 26 where connected to a single second portion 28.

The first portion 26 has a horizontal bar 30, which is surrounded by a protective pad 32 such as a foam material covered with leather or plastic; for protecting a person who may strike it such as by jumping on it. The horizontal bar 30 is attached to the trampoline pad 18 by struts 34. In FIG. 2 five of these assemblies are shown, in a row, to form outer edge 16*d*.

A flexure bar 36 is attached at its upper end 38, to the horizontal bar 30 and terminates at a lower end 40. The flexure bar 36 is curved outwardly along most of its length and made of spring steel in order to function as a spring.

In its unstressed condition flexure bar 36 is in the position as shown in FIG. 4, and in solid lines in FIG. 6.

Figure 5:
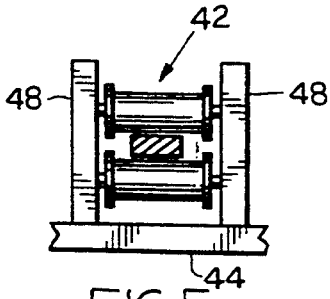
FIG. 5 is a view through 5—5 of FIG. 4.

A control assembly 42 is shown in FIGS. 4, 5 and 6. The control assembly 42 has a base 44, an upper set of brackets 46 and a lower set of brackets 48. Mounted on the brackets 46 are spaced, opposed rollers 50, 52, and mounted on the brackets 48 are spaced opposed rollers 54,56. The flexure bar 36 extends through the space between the two pairs of rollers 50,52, and 54,56. The control assembly keeps the lower portion of the flexure bar 36 in place, so that upon application of force, it will not move laterally.

The second control portion 28 has a container 58, which has a removable cap 60, a lower retainer 62 and an upper retainer and guide 64. The lower end 40 of the flexure bar 36 is fixed onto the upper retainer and guide 64. A spring 66 resides between the lower retainer 62 and the upper retainer and guide 64.

In operation the amusement device is used by a person starting from the platform 14 and jumping onto the first trampoline assembly 10*a* and successively to the last trampoline assembly 10*e*, and finally off the device to the landing area (not shown).

In the ready to use position, a trampoline pad 18 is in the position shown in solid lines in FIG. 6 the support assemblies 24*a*–24*d* in FIG. 3 also showing the ready to use position. The first portion 26, of the support assembly 24 is biased laterally outwardly to hold the trampoline pad 18 generally flat, as shown in solid line in FIG. 6, and in FIG. 4. When a person jumps on the trampoline pad 18, as shown by force vector "f" in FIG. 6, the flexure bars 36 will flex or deflect inwardly such as shown in by position "m" in FIG. 6. There may be a small amount of compression of spring 66; however it is anticipated that most of the force on the control assembly 42 will be horizontal force as shown by arrow A in FIG. 4. A greater force may occur such as if the person or persons are heavier, or jump from a greater height. Also, a person may jump close to or on top of the side 16*d*, an undesirable effect; but one for which this apparatus is intended to compensate and protect the user against injury. For, in such case, the vertical force vector "b" will be quite large, and the second portion 28 will come into greater play. In such case the entire first control portion 26 will be forced downward, the spring, which resiliently biases it upward, will compress to absorb the force. This action is shown by position "n" in FIG. 6 and by the control assembly 24*e* in FIG. 3.

When the force "f" is removed, the flexure bar 36 will restore to its original position due to the resilience provided by its spring restoring force. Similarly, the spring 66 will return to its uncompressed position when the force "f" is removed due to its spring restoring force.

Therefore, the first support portion 26 (lateral support portion) is inwardly movable against the outward biasing force of the flexure bar 36. The second support portion 28 (vertical support portion is vertically downwardly moveable against the upward biasing force of spring 66.

The spring biasing forces of flexure bar 36 and spring 66 can be selected to operate as above explained. Selection of these forces can be made to vary the interaction of lateral flexure of flexure bar 36 and of spring 66; such as for example that, compression of spring 66 would commence an application of a lesser or greater vertical force "b".

This amusement device differs considerably from an ordinary trampoline. This device comprises an accelerator or energy storage device (lift 15) and the series of trampoline 10. In the case of an ordinary trampoline, the player must use his body to provide the forces to enable jumping up and down on the trampoline; therefore the amusement value of an ordinary trampoline is affected by the strength and energy available from the user's own body, that is, a limitation based on fatigue. Use of a normal trampoline can be seen as two separate stages. In the first stage a maximum jump height is attained. This requires addition of a lot of energy from the user to progressively obtain greater jump height, until the desired jump height is attained. In the second stage, an achieved height is maintained. In this stage the drop from the achieved height contributes energy, so the user only has to add sufficient new energy to continue at that achieved height.

In the present invention, the enjoyment available derives from the multiple jumps, downhill so to speak, enhanced by the great reduction of fatigue. This latter affect is contributed by the lift 15 which adds potential energy by lifting the player to the top. This energy is then available as potential energy to be converted to kinetic energy through each jump until the player reaches the ground level. The energy contributed by the lift helps to achieve the jump height for each successively lower trampoline, with little or no added energy needed. Therefore the player doesn't need to use much personal body energy and is able to play for a long time. The distance between trampoline assemblies is shown to be equal in FIG. 1. But, the distance between trampoline assemblies can vary. This variation can be random to increase interest and challenge, or could be patterned to accommodate changes in energy expended.

It is appreciated that kinetic energy available from each level to the next lower level is partially absorbed by friction upon hitting the next lower trampoline. Thus the vertical height difference compensates for the energy absorbed by the trampoline in progressing from a higher trampoline to a lower trampoline. Therefore the height difference can be chosen to provide a predetermined amount of additional kinetic energy. That height is chosen to compensate for the energy absorbed by the trampoline. Similarly the characteristics of the trampoline can be designed for greater or less absorption or stiffness. Also, the trampoline springs can be changed or adjusted to modify the stiffness.

Figure 7:
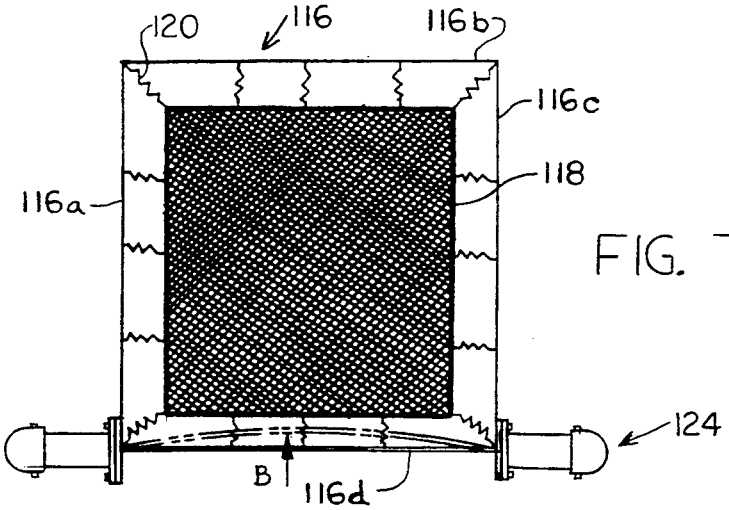
FIG. 7 is a plan view of a trampoline assembly showing an alternative embodiment of the support assembly.
Figure 8:
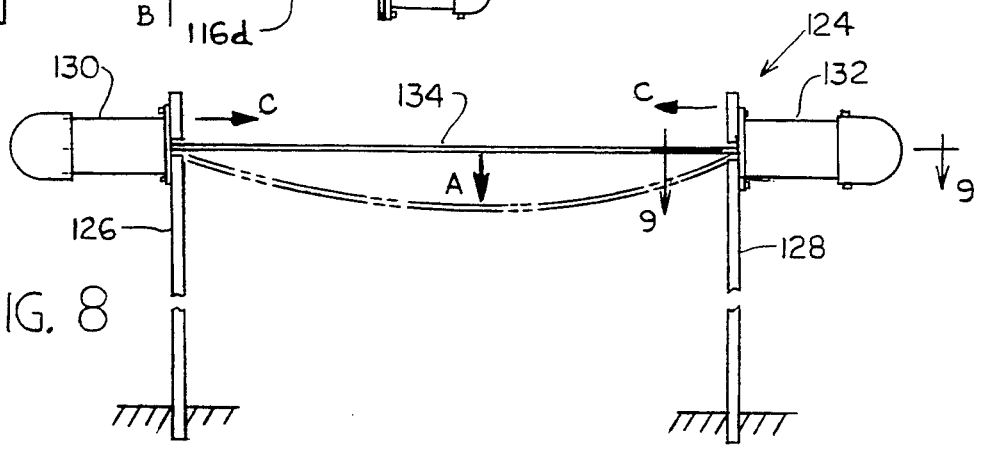
FIG. 8 is a front view showing the alternative embodiment of the support assembly.

Another embodiment of the invention is shown in FIGS. 7–10. In this embodiment the support structure differs in that a different suspension assembly is used at the outer edge of the trampoline. In other respects and in its general mode of operation this embodiment is the same as the prior defined embodiment; except for the mode of operation of the suspension assembly. Referring to FIGS. 7 and 8 there is shown a trampoline assembly which has a rigid peripheral frame structure 116 comprising three sides 116*a*, 116*b* and 116*c* of similar construction. A fourth side 16*d* is of a different construction to be described in detail below. A trampoline pad 118 is situated centrally in the frame 16. The pad 118 is held in place by springs 120 distributed around the pad 118 between the pad 118 and the frame 116. Side 116*b* defines an inner edge of the trampoline and side 116*d* defines an outer edge of the trampoline. The inner edge 116*b* is seated on the slope as schematically shown at 22 in FIG. 1 with reference to the prior embodiment. The outer edge 116*d* is situated comparably to 16*d* in FIG. 1. The plurality of trampoline assemblies and their general function is as described for the prior embodiment.

The outer edge 116*d* has a flexible, resilient biased suspension assembly 124 which comprises support beams 126 and 128, a spring assembly 130 on support beam 126 and a spring assembly 132 on support beam 128, and a wire 134 extending between the spring assemblies 130 and 132.

Referring to FIGS. 9 and 10, the spring assemblies 130 and 132 are identical and mounted oppositely on their respective support beams 126 and 128. The spring assemblies 130 and 132 comprise a tube 136 having flanges 138 which facilitate bolting to the support beams 126 and 128. Each tube is capped by a removable cap 140. Inside the tube 136 is a coil spring 142 which bears at its inner end 144 against the floor 148 inserted in the tube 136 and at its outer end 148 against a rider 150. The rider 150 has a central hole 152 through which is mounted a threaded hook 154. Threaded to the threaded hook 154 is a nut 156 on the outside of the rider 150. The wire 134 passes through a hole 158 in the support beams 126 and 128 and through a hole 160 in the floor 148 of the respective spring assemblies 130 and 132. The wire 134 then passes centrally through the tube 136 and the coil spring 142 and is hooked over the hook portion 162 of the threaded hook 154 by means of a bight 164 and clamp 166.

Figure 9A:
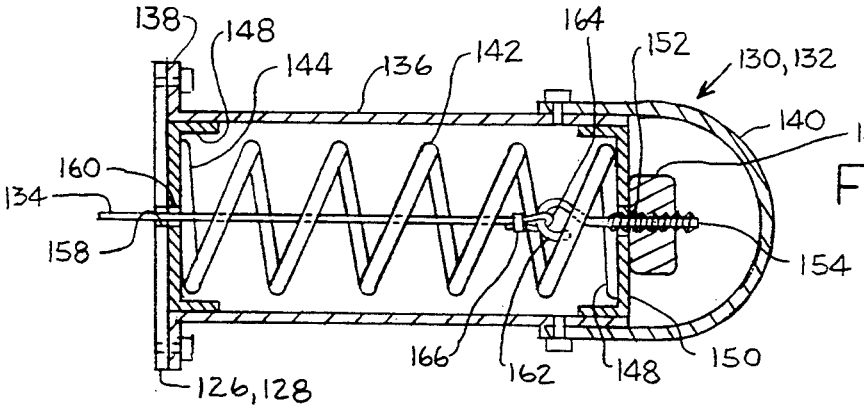
FIG. 9A is an enlarged sectional view through 9—9 of FIG. 8 of the spring restraint Structure of the alternative embodiment in an expanded position.
Figure 9B:
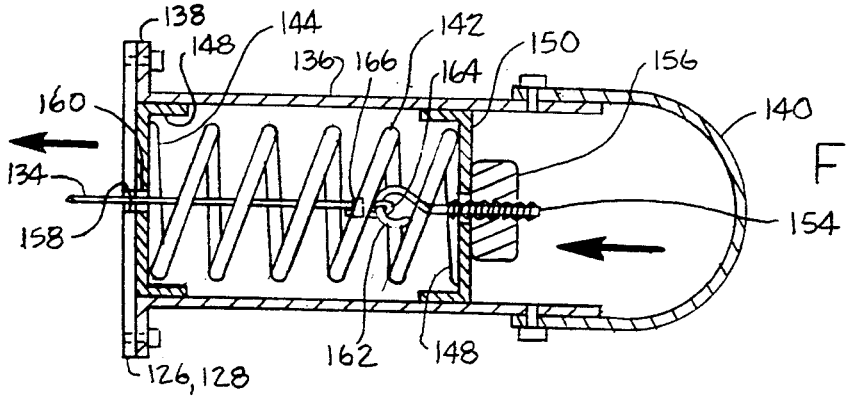
FIG. 9B is an enlarged sectional view through 10—10 of FIG. 8 of the spring restraint structure of the alternative embodiment in a contracted position.

Therefore the outer edge 116*d* has the additional feature, not available on edges 116*a*, 116*b* and 116*c* that it can flex downwardly as shown by arrow A in FIG. 8 and inwardly as shown by arrow B in FIG. 7 and by overcoming the biasing force of the spring assemblies 130 and 132 can move inwardly as shown by arrows B in FIG. 7. In normal use a combined inward and downward force vector will occur, causing partial inward and downward flexure. At some level of force the springs 142 will contract, depending on their selected spring rates. This will allow the total displacement of the wire 134 to be greater. The greater the displacement, the more force can be absorbed. When the force is removed the spring assemblies resiliently restore to the ready position. These flexure modes, as explained with respect to the prior embodiment provide safety if a user hits or comes too close to the edge 116*d*. In particular if the wire is as shown by arrows A and B, the spring 142 will contract from the expanded position shown in FIG. 9A to a more stressed position as shown in FIG. 9B. This permits the wire 134 to also move as shown by arrows B, absorbing energy as it does so. When force on the wire 134 is released and it is free to return to the more relaxed position, the spring 142 will relax and return to its expanded position.

Tension on the wire 134 can be adjusted through the threaded hook 154 and the nut 156 by tightening or loosening the nut 156. The initial tension on the wire 134, and therefore the initial contraction of the springs 142 will be in a first position to establish good support for the trampoline pad 118 putting the wire under a predetermined tension. When a user jumps on the trampoline pad 118, the wire 134 will deflect downward as shown in arrow A and the springs will increase their bias, contracting to some extent as in FIG. 9B, thereby allowing the wire 134 to both downwardly deflect (arrow A) aided by the contraction of the springs (arrows B). In normal use this deflection or flexing will be slight, so as to not absorb much energy; thereby allowing a good trampoline effect. But, if the user is too close to the wire 134, the deflection and flexing of the wire 134, controlled by the springs 142 will prevent injury and absorb the shock. If a user jumps close to or onto the wire 134, the deflector will be greater and the contraction or biasing of the springs 142 will be greater.

In constructing the device, the tension is set and the spring rate of the springs 142 preferably establish a first mode of deflection of the wire 134 responsive to a normal range of forces from proper use of the trampoline. In this first mode the springs 142 will not contract, or will contract only slightly, the deflection of the wire 134 occurring due to its own ability to stretch and also due to its not being overly taught. The second mode will occur when a higher range of force is imposed on the wire such as by a user jumping too close, or directly onto the wire. In this mode the springs 142 will contract in response to the higher tension transmitted to the ends of the wire 134. Even where two distinct modes are designed there will be anomalies such as proper use by a heavy user which will cause the springs to contract. Also, the design could be made to allow the second mode to occur even in proper use, for example in order to control overly enthusiastic users to absorb energy from the trampoline pad.

While two spring assemblies 130, 132 are shown the device could be constructed with only one, on one side, the other end of the wire being solidly anchored to the support beam.

The entire support structure and especially the spring assemblies are preferably protected by a soft padding such as foam in case a user should strike it.

As a further alternative to the embodiment of FIGS. 2–5 or to the embodiment of FIGS. 7–9; the inner boundary (or edge) 16*b* or the inner boundary (or edge) 116*b* could be constructed as is the outer boundary (or edge) with the support assembly described in FIGS. 3–5 or the support structure described in FIGS. 7–9. In such cases the overall height of the support assembly or support structure would be shorter in order to accommodate to the uphill slope, that is for example the flexure bar 36 would be shorter, and the support beams 126 and 128 would be shorter in their respective assemblies.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A trampoline type amusement device comprising; a series of at least two trampoline assemblies arranged serially laterally adjacent and vertically offset from an uppermost first one of said trampoline assemblies to successive laterally adjacent lower trampoline assemblies to a lowest last one of said trampoline assemblies.

2. The device of claim 1 wherein each trampoline assembly has a lateral inner boundary and a lateral outer boundary, the lateral inner boundary of each trampoline assembly, except for the uppermost first trampoline, being placed generally vertically below the lateral outer boundary of the next prior adjacent trampoline.

3. The device of claim 2 further wherein each trampoline assembly comprises a trampoline pad and a support structure defining a peripheral support for said trampoline pad and including said lateral inner and outer boundaries and connecting means to suspend said trampoline pad from said support structure and a deflectable portion of said support structure being deflectable from a first ready to use position in a first mode upon imposition of a first force range and being further deflectable in a second mode upon imposition of a second force range which is greater than the first force range said deflectable portion being resilient to restore to its first position when said forces are removed.

4. The device of claim 2 further wherein each trampoline assembly comprises a trampoline pad and support structure defining a peripheral support for said trampoline including said lateral inner and outer boundaries and connecting elements between said support structure and said pad to support said pad within the periphery defined by said structure and said support structure having at least one of said lateral inner boundary and said lateral outer boundary being deflectable upon imposition of a force exceeding a selected limit said deflectable portion being resilient to restore to its undeflected position when said exceeding force is removed.

5. The device of claim 4 said deflectable portion comprising;

a vertical support portion comprising a resilient downwardly moveable upwardly biased portion adapted to move downwardly when force overcoming the upward biasing is applied.

6. The device of claim 5, said support apparatus deflectable portion further comprising:

a lateral support portion comprising a resilient inwardly movable outwardly biased portion adapted to move inwardly when force overcoming the outward biasing is applied and a vertical support apparatus;

7. The device of claim 6 wherein;

the support mechanism deflectable portion further comprises an upper member to which the connecting means is attached; and the resilient inwardly moveable outwardly biased portion comprises a flexure bar attached at a top end to the upper member and extending inwardly and downwardly to a lower end; and means to restrain the lower end from inward movement while allowing the upper end to move inwardly, thus permitting flexing of the flexure bar; and wherein the vertical support apparatus comprises a vertically collapsible spring attached to the lower end of the flexure bar adapted to permit downward movemetn of the flexure bar.

8. The device of claim 7 wherein the flexure bar and vertically collapsible spring have preselected biasing force to operate in a mode selected from one of the following upon application of force having vertical and lateral components:

(a) the flexure bar alone will flex and the vertical spring will not collapse.

(b) the flexure bar will first flex and then the vertical spring will collapse.

(c) the vertical spring will collapse and the flexure bar will not flex.

(d) the vertical spring will first collapse and then the flexure bar will flex.

9. The device of claim 1 further comprising an apparatus for carrying a person from a lower point proximate the vertical position of the lowermost trampoline to a higher point proximate the vertical position of the uppermost trampoline.

10. A trampoline type amusement device comprising;

a support structure defining a peripheral support for a trampoline;

a trampoline pad having edges defining a closed periphery supported within said support structure by a plurality of spaced apart connecting elements arranged between and attached to said pad around said periphery and said support structure;

said support structure having a rigid portion and a deflectable and resiliently biased portion having a first ready to use position orienting the trampoline pad for use and being deflectable from said first position in response to applied force and further being resiliently restorable to the first position when the force is removed.

11. The device of claim 10 wherein the deflectable and resiliently biased structure comprises;

a flexible elongate member adjacent at least a portion of the trampoline pad and having ends, at least a a portion of the trampoline pad being attached to the said elongate member by some of said connecting elements;

a resilient biasing assembly attached to at least one of said ends having a biasing element which places said elongate member in predetermined tension thereon to establish said first position and capable of allowing movement of said end in response to increased tension due to force application to allow deflection of said elongate member from said first portion and capable of resiliently restoring said elongate member to the first position when the force is removed.

12. The device of claim 11 wherein said resilient biasing assembly comprises a spring holding one end of said elongate member under predetermined tension in said first position to maintain said trampoline pad in ready to use position, and which will allow said end to move in response to force on said elongate member which overcomes the spring biasing resistance of said spring.

13. The device of claim 12 wherein each end of said elongate member is attached to a said resilient biasing assembly.

14. The device of claim 13 wherein said trampoline pad has at least one straight edge portion and said elongate member extends adjacent said straight edge portion and said trampoline pad is attached to said elongate member.

15. A trampoline type amusement device comprising:

a trampoline pad having edges defining a closed periphery;

a support structure adjacent said edges of said trampoline pad;

connecting elements connecting said closed periphery of said trampoline pad to said support structure;

said support structure having rigid portions and a deflectable portion said deflectable portion being deflectably responsive to downward force upon said trampoline pad.

16. The device of claim 11 wherein said elongate member is a cable.

17. The device of claim 15 wherein said trampoline periphery is rectangular and said rigid portions are adjacent and connected to three sides of said periphery, and said deflectable portion is connected to the fourth side of said periphery.

18. The device of claim 17 wherein said deflectable portion comprises a flexible elongate member having ends, said ends being held in at least one position.

19. The device of claim 18 further comprising a spring biasing element attached to at least one end of said elongate member the point of attachment having a first position to place said elongate member under predetermined tension due to said spring biasing element and said spring biasing element providing a range of movement for said end upon increased tension of said elongate member overcoming the spring retaining force of said spring biasing element, and said spring biasing element restraining the end of the elongate member to the first position upon removal of the increased tension.

20. The device of claim 19 the predetermined tension being adjustable.

21. The device of claim 20 wherein the spring biasing element is a coil spring having one end fixed and having the end of the elongate member attached to the other end of the coil spring and oriented to allow movement of the said end of the elongate member generally along the axis of the coil spring.

22. The device of claim 21 wherein the elongate member extends into the coil spring past its fixed end and is attached at the other end of the coil spring whereby increased tension on the elongate member causes contraction of the coil spring.

23. The device of claim 19 wherein there is a said spring biasing element at each of the ends of the elongate member.

* * * * *